US008272164B2

(12) United States Patent
Albrecht

(10) Patent No.: US 8,272,164 B2
(45) Date of Patent: Sep. 25, 2012

(54) DOUBLE HUNG SASH LOCK WITH TILT LOCK RELEASE BUTTONS

(75) Inventor: Scott D. Albrecht, Merrill, WI (US)

(73) Assignee: HWD Acquisition, Inc., Medford, WI (US)

( * ) Notice: Subject to any disclaimer, the term of this patent is extended or adjusted under 35 U.S.C. 154(b) by 316 days.

(21) Appl. No.: 12/570,535

(22) Filed: Sep. 30, 2009

(65) Prior Publication Data

US 2010/0083578 A1 Apr. 8, 2010

Related U.S. Application Data

(60) Provisional application No. 61/102,121, filed on Oct. 2, 2008.

(51) Int. Cl.
*E05D 15/22* (2006.01)

(52) U.S. Cl. ..... 49/185; 48/183; 292/DIG. 20; 292/DIG. 47

(58) Field of Classification Search ..... 49/176, 49/183, 184, 185, 449; 292/DIG. 20, DIG. 47, 292/32, 37, 39, 42, 6, 61, 140, 142, 145
See application file for complete search history.

(56) References Cited

U.S. PATENT DOCUMENTS 5,992,907 A 11/1999 Sheldon et al.
6,155,615 A * 12/2000 Schultz ..... 292/163
6,485,070 B1 * 11/2002 Schultz ..... 292/175
6,565,133 B1 5/2003 Timothy
6,588,150 B1 7/2003 Wong et al.
6,722,712 B2 * 4/2004 Schultz ..... 292/175
6,874,826 B1 4/2005 Polowinczak et al.
6,948,278 B1 * 9/2005 Schultz ..... 49/185
6,957,513 B2 10/2005 Pettit et al.
7,017,957 B2 * 3/2006 Murphy et al. ..... 292/241
7,070,215 B2 7/2006 Kelley et al.
7,147,255 B2 12/2006 Goldenberg et al.
7,431,355 B2 * 10/2008 Eenigenburg et al. ..... 292/175
7,520,541 B1 * 4/2009 Lawrence ..... 292/175
7,591,103 B2 * 9/2009 Tremble et al. ..... 49/185
7,658,035 B1 * 2/2010 Lawrence ..... 49/185
7,976,077 B2 * 7/2011 Flory et al. ..... 292/36
8,020,904 B2 * 9/2011 Flory et al. ..... 292/241
2006/0192391 A1 8/2006 Pettit et al.

* cited by examiner

*Primary Examiner* — Jerry Redman
(74) *Attorney, Agent, or Firm* — Merchant & Gould P.C.

(57) ABSTRACT

A combination tilt/sash lock for mounting to a window sash rail, the combination including a sash lock and tilt lock being mounted in linear relationship to each other; the tilt lock having a latch element latching to a window frame that is manually movable within a tilt lock housing between a latched position and an unlatched position; the sash lock having a rotatable cam movable by rotating a locking lever between a locked position and an unlocked position; the sash lock locking lever being located in a superimposed linear relationship to and blocking manual movement of the tilt lock in the locked position and allowing movement of the latch element in the unlatched position; and the tilt lock mechanism being movable from a latched position to a disengaged position.

23 Claims, 8 Drawing Sheets

DOUBLE HUNG SASH LOCK WITH TILT LOCK RELEASE BUTTONS

CROSS REFERENCE TO RELATED APPLICATION

Priority under 35 U.S.C. §119(e) is claimed to provisional application Ser. No. 61/102,121 filed Oct. 2, 2008. The complete disclosure of application 61/102,121 is incorporated by reference herein.

TECHNICAL FIELD

The present disclosure is related to a combination tilt lock and sash lock for double hung window sashes that open and close vertically and tilt from the vertical plane.

BACKGROUND

Double hung and single hung windows are comprised of two window sashes mounted in adjacent parallel window frame tracks. Single hung windows typically have the upper sash fixed while the lower sash is moveable in the vertical axis. Double hung windows typically have top and bottom sashes that are both moveable in the vertical axis. Traditional double and single hung windows typically used nailed in-place wooden stops to hold the sash into the window frame. As such, washing of the outside of traditional double and single hung windows must generally be done from the outside of the building, due to the difficulty and possible damage of removing sash stops to allow sash removal. In many instances, a storm/screen window has to be removed prior to washing the window exterior. Windows located above ground level also require the use of a ladder to reach the units making it more difficult and inconvenient to perform exterior cleaning.

With the evolution of the double and single hung window, the fixed wooden stops holding the sash into the frame were replaced by metal or plastic compression jamb liners containing the sash balance systems and slide track. The jamb liners allowed improved ease of sash removal, allowing the window sash to be washed on both sides from the inside of house. Removal of the sash from the jamb liner system usually required considerable physical strength, which made sash removal difficult or impossible for many people to clean the entire window. Further refinement of the hung window resulted in the tiltable sash which allowed cleaning of both sides of the sash with minimal physical effort to tilt the sash into the interior of the house.

Early tilting sash single and double hung windows incorporated tilt locks on the top corners of each operating sash and tilt pins at the bottom corners of the sash which engaged the jamb track to hold the sash into the frame. The evolution of the tilt single and double hung window has changed how the lock and tilt lock mechanism operates, but adhered to the basic tilt lock and tilt pin concept. Most of the evolved lock and latch systems became more complicated and as a consequent more expensive.

"Sash lock" or "sweep lock" is the common name of a cam lock mounted on an upper rail or check rail of a lower sash to lock the lower sash to a fixed or movable upper sash in a window. Sash or sweep locks can be used in pairs spaced toward the sides of window sash to interlock the check rails of a pair of closed sash. Check rails are the lower horizontal element of the upper sash and the upper horizontal element of the lower sash which interface together when a double hung window is in the closed position. When locked, sweep locks prevent either sash from moving toward an open position and also strengthen the wind resistance of the closed sash.

"Tilt lock" or "tilt latch" is the common name of a latch or lock that keeps a tiltable sash in an upright position for traveling vertically between open and closed positions within a window jamb. Ordinarily, a pair of tilt locks are arranged at stile edges of a lower sash to latch into vertical slots in a window jamb where the tilt locks prevent a lower sash from tilting until the tilt locks are manually unlocked.

Since sweep locks and tilt locks are both mounted on an upper rail of a lower sash, there have been several suggestions in the patent literature that these devices be combined. See for example U.S. Pat. Nos. 1,120,186; 5,090,750; 5,244,238; 5,398,447; and 5,791,700. These suggestions suffer from disadvantages.

Latches in which both sash locking and tilt locking are controlled with one lever can have difficulty providing smooth, consistent and reliable operation over their expected useful life. One disadvantage with single lever type latches is the possible accidental tilting of the sash when unlocking the unit. Another disadvantage of some latches is the poor adjustability of the lock/latch connections. Improvements in combined sash and tilt lock mechanisms are desired.

SUMMARY

A combined sash lock and tilt lock mounted with a window frame is provided, the combination includes a sash lock and tilt lock being mounted in a superimposed linear relationship to each other; the tilt lock having a latch element latching to a window frame that is manually movable within a tilt lock housing between a latched position and an unlatched position; the sash lock having a rotatable cam movable by rotating a locking lever between a locked position and an unlocked position; the sash lock locking lever being located in a superimposed linear relationship to and blocking manual movement of the tilt lock in the locked position and allowing movement of the latch element in the unlatched position; and the tilt lock mechanism being movable from a latched position to a disengaged position.

BRIEF DESCRIPTION OF THE DRAWINGS

The foregoing and other features and advantages will become apparent to those skilled in the art upon reading the following description with reference to the accompanying drawings, in which.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

The presently disclosed combination tilt/sash lock has a lock lever that operates the sash lock and a separate button on the lock housing that releases the tilt lock when depressed in a linear direction. Having a separate tilt lock release button on the lock housing prevents unintentional and/or accidental disengagement of the tilt lock when unlocking the sash via the sash lock lever. One way this may be accomplished is by configuring the combination tilt/sash lock such that the sash lock lever is arranged in a superimposed linear relationship with the tilt lock release button when the sash lock lever is in a locked position. By use of the term "superimposed linear relationship" it is meant that the longitudinal axes of the sash lock lever and the tilt lock release button are aligned in the same general direction with one axis being generally above the other when viewed from the top of the window frame. This arrangement allows for movement of the tilt lock release button when the sash lock is in the unlatched position, but prevents the tilt lock release button from being depressed when the sash lock lever is in the locked position. Such a configuration provides for the safe operation of the window and is also economical and less complicated as it basically has only seven parts that can be configured to operate on both sides of a window.

Figure 1:
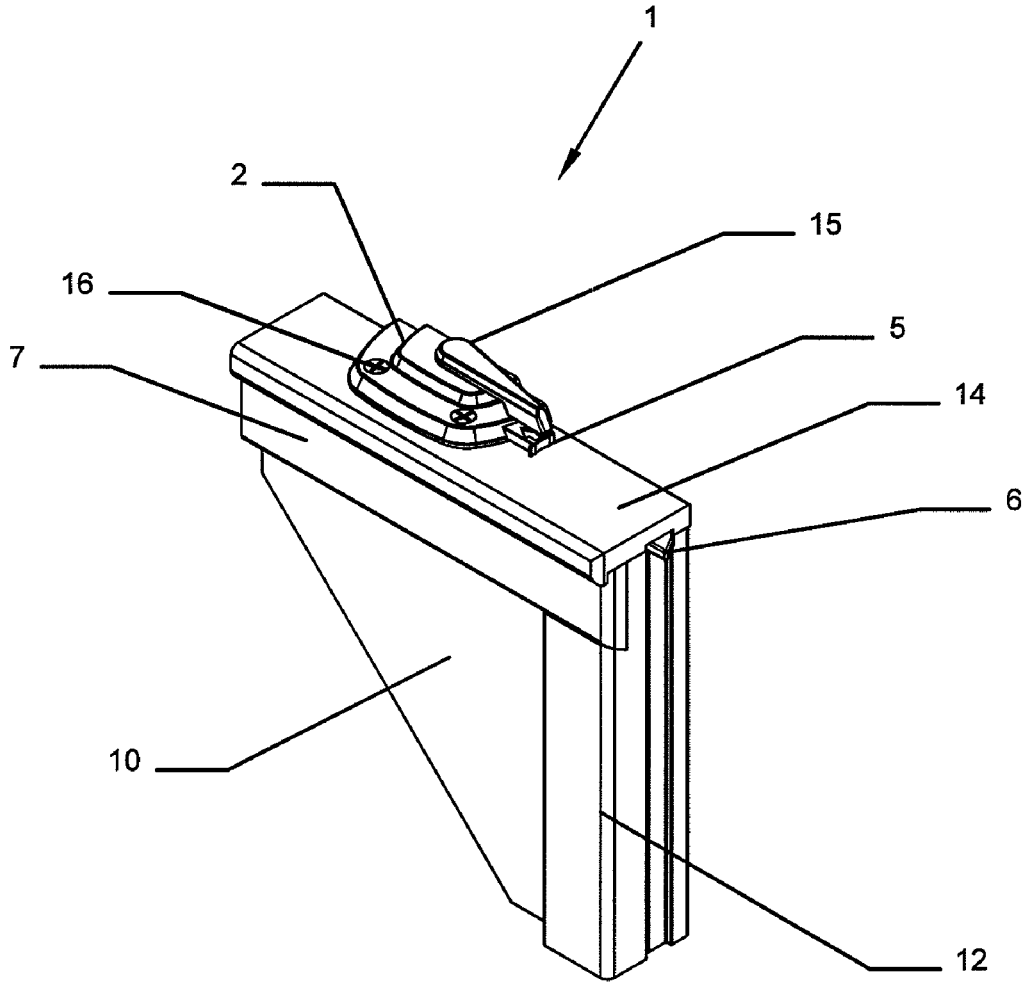
FIG. 1 is a perspective view of a first embodiment of a sash corner showing the combination tilt/sash lock in the locked and engaged positions.
Figure 2:
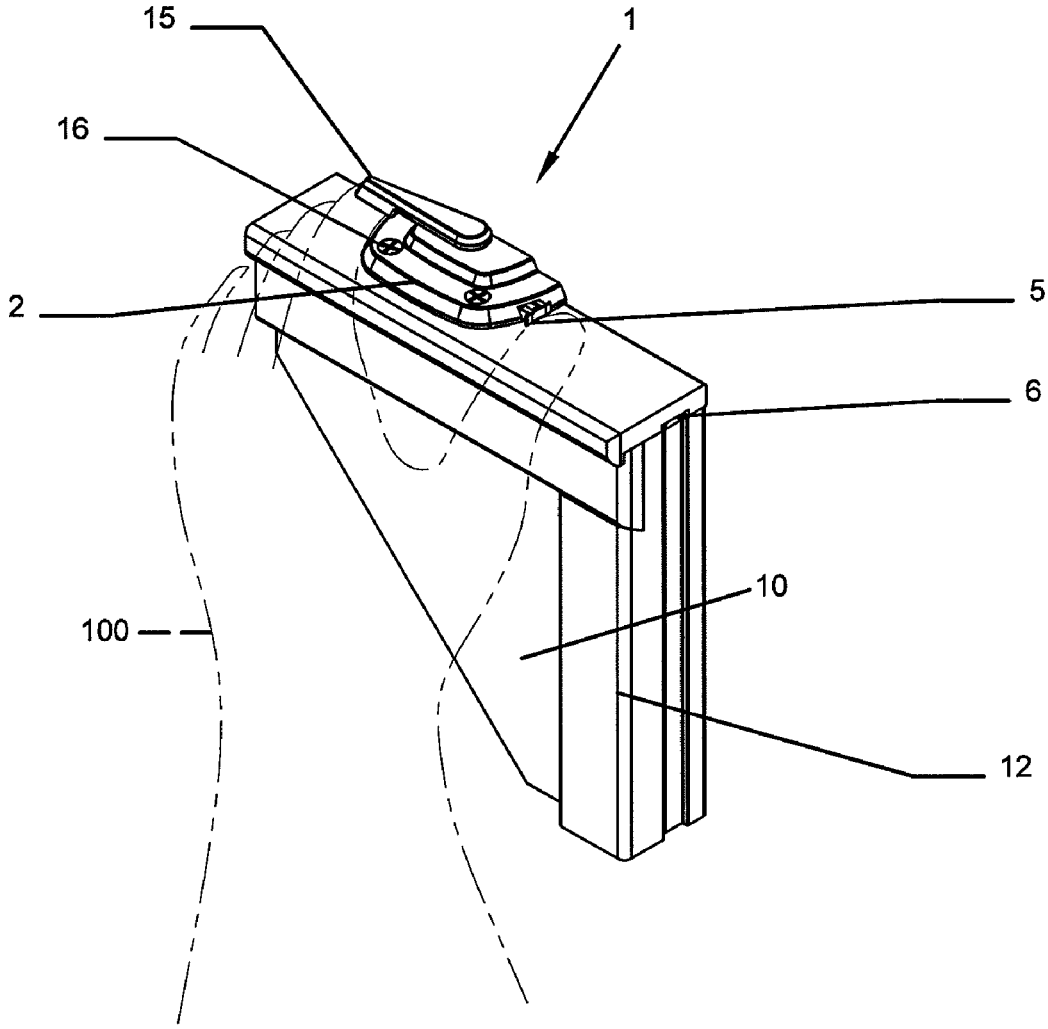
FIG. 2 is a perspective view of a sash corner showing the combination tilt/sash lock of FIG. 1 in the unlocked and disengaged positions.
Figure 6:
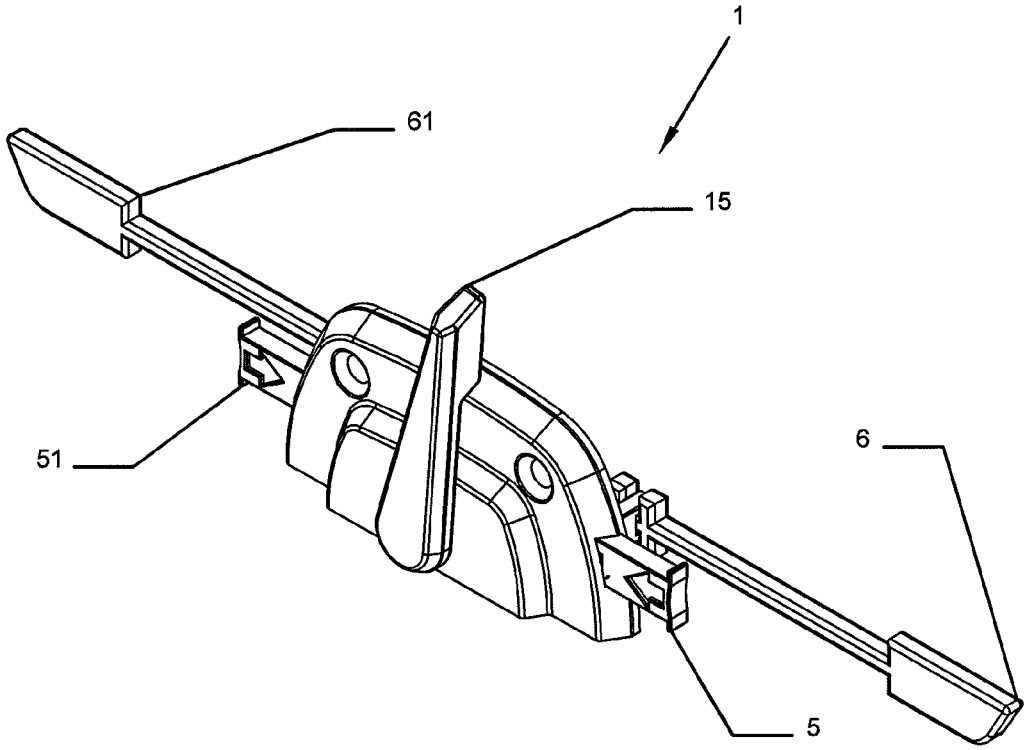
FIG. 6 is a top perspective view of a first embodiment of a combination tilt/sash lock having two tilt locks.
Figure 7:
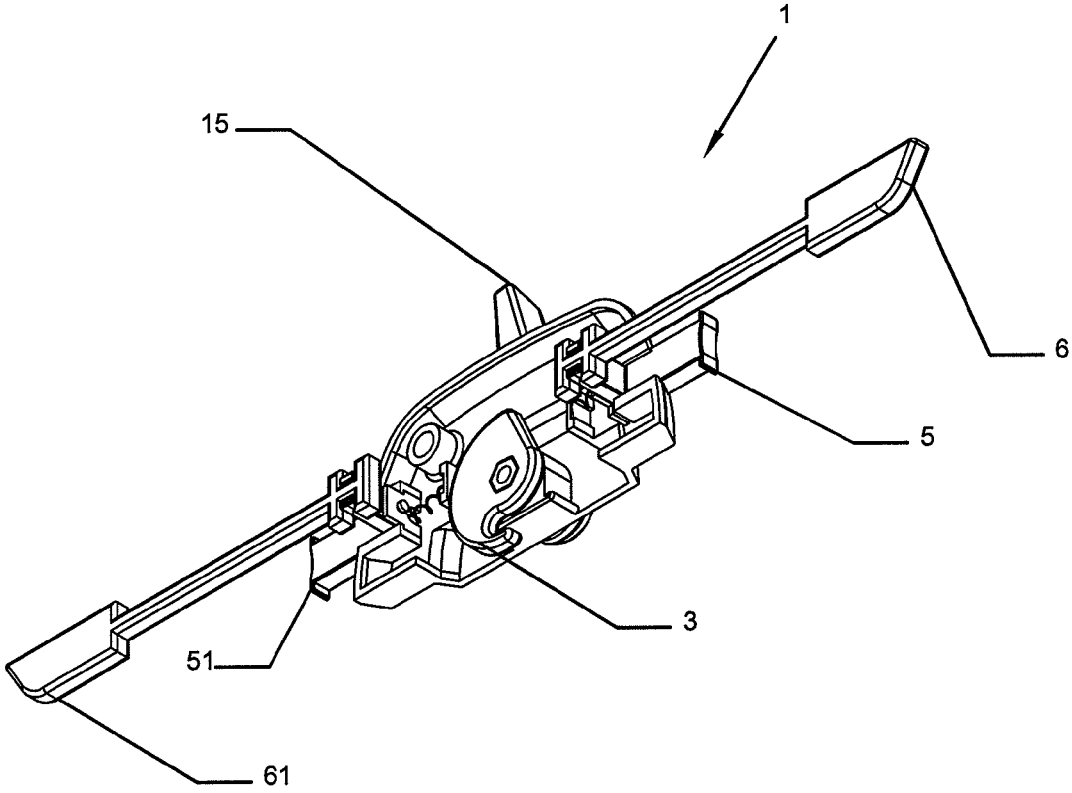
FIG. 7 is a bottom perspective view of the combination tilt/sash lock of FIG. 6.
Figure 8:
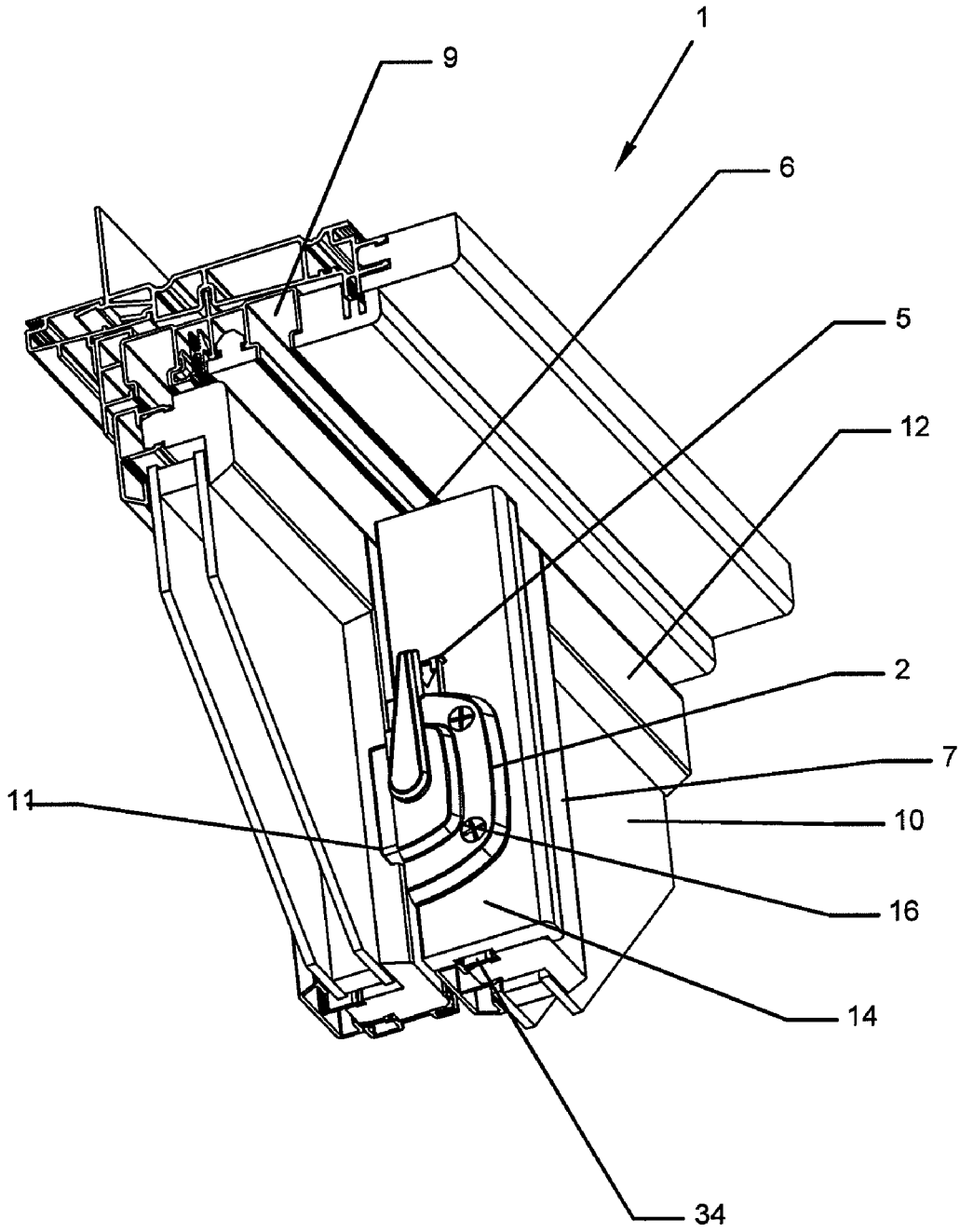
FIG. 8 is a perspective view of the upper and lower sash check rail and associated jamb and showing the combination tilt/sash lock of FIGS. 1 and 2.

In the embodiment presented at FIGS. 1-8, a combination tilt/sash lock 1 is shown, the combination being shown as mounted on a lower double/single hung window sash 10 in FIGS. 1, 2 and 8 (partially shown). As shown, window sash 10 includes check rail 7, rail cover 14 and stile 12. The combination tilt/sash lock 1 is for locking and unlocking window sash 10 such that window sash 10 can be enabled or prevented from moving in the vertical direction. The combination tilt/sash lock 1 is also for locking and unlocking the window sash 10 such that window sash 10 can be enabled or prevented from tilting into and out of the window frame. FIG. 1 shows the combination tilt/sash lock 1 in the locked position such that the sash 10 is prevented from both moving in a vertical direction and from tilting. FIG. 2, shows the combination tilt/sash lock 1 in the unlocked position such that the sash 10 is enabled to both move in the vertical position and to tilt. The aspects of combination tilt/sash lock 1 which enable this operation are described in the following paragraphs.

One aspect of the disclosure is the sash lock mechanism. The sash lock mechanism represents the collection of components associated with combination tilt/sash lock 1 that are responsible for working together to prevent or enable vertical movement of the window sash 10. Many configurations of a sash lock mechanism are possible without deviating from the principles presented herein. The sash lock mechanism can include any locking mechanism, such as a rotating cam style lock, a linear action slide lock, or any other type of lock that will operate to securely fix the lower sash of a double hung window to the upper sash of a double hung window such that lower and upper sashes can not be opened from the exterior side of the window. To operate the sash lock, a lever mechanism is generally provided. However, other types of mechanisms known in the art are also suitable. Many configurations of sash lock mechanisms are possible without departing from the concepts presented herein. In the particular embodiment shown in FIGS. 1-8, the sash lock mechanism includes a lock housing 2, a lock lever 15 and a locking cam 3 which is a cam style lock. The lock lever 15 is attached to locking cam 3 by passing it through an opening 24 in housing 2 and engaging hexagonal opening 26 in locking cam 3. In operation, by rotating lock lever 15, locking cam 3 will engage or disengage a lock keeper 11 which will be located on the bottom check rail of the upper window sash (shown in FIG. 8), as are known in the art. Thus, locking cam 3 allows the sash lock mechanism to be moved between a locked and an unlocked position via lock lever 15. Lock housing 2 is retained onto window sash via screws 16 such that the entirety of combination sash/tilt lock 1 is secured. Of note, lock lever 15 extends beyond lock housing 2 such that, when in the locked position, the lock lever 15 prevents the depression of tilt lock release button 5, discussed later.

Another aspect of the disclosure is the tilt lock mechanism. The tilt lock mechanism represents the collection of components associated with the combination tilt/sash lock 1 that are responsible for working together to prevent or enable the tilting of window sash 10. The tilt lock mechanism can include any locking mechanism, such as a cam type lock, a linear action slide lock, or any other type of lock that will operate to secure the window from tilting out of the frame. To operate the tilt lock, a lever mechanism is generally provided. However, other types of mechanisms known in the art are also suitable. Many configurations of tilt lock mechanisms are possible without deviating from the principles presented herein. In the particular embodiment shown in FIGS. 1-8, the tilt lock mechanism includes tilt lock 6, tilt lock release button 5, biasing spring 4 and tilt lock retaining clip 30. As shown, the tilt lock release button 5 is an "L" shaped piece having one end 40 being the button and the other end 42 being a "U" shaped piece to engage the "H" shaped end 44 of tilt lock 6. Other shapes are possible. The tilt lock 6, configured to move in a linear direction, is shown as having a latch end 46 that is cammed like a door latch to allow the latch to be readily reengaged. The biasing spring 4 biases the tilt lock lightly toward the latched position. As shown, biasing spring 4 is a helical spring, however, other types of springs are suitable. The retaining clip 30 retains tilt lock release button 5 and biasing spring 4 within housing 2.

To assemble the tilt lock components, the tilt lock biasing spring 4 is inserted into a hollow portion of the tilt lock release button 5. The tilt lock button 5, with the biasing spring 4 inserted, is then slid into a tilt lock button slot 8 on housing 2 and is then depressed to its maximum distance thereby allowing the insertion of the tilt lock retaining clip 30 into a retaining clip receiver slot 32 in housing 2. Once retaining clip 30 is inserted, the tilt lock button 5 is locked into the tilt lock button slot 8.

With this configuration, the tilt lock 6 can be manually retracted in a linear direction against the spring pressure to tilt a sash 10 from a latched position to an unlatched position. In the unlatched position, the window can be moved from an upright to a tilted position. It should be noted that the housing 2 also acts as a pull handle for a person's hand 100 when tilting the window as shown in FIG. 2. While the tilt button is pushed in with the thumb, the index finger will be positioned on the opposite side of housing 2, thereby providing a counter acting pinching force between the thumb and the index finger. This pinching force allows the housing 2 to be used as a pull handle such that the operator can easily tilt the sash 10. This is an improvement over a flush mounted tilt latch wherein there is nothing to hold on to for tilting the sash 10 other than finger friction. When moving the sash 10 to the latched position, the tilt lock 6 will cam over a window jamb and snap into jamb grooves (not shown) of a window frame as the sash 10 is moved from a tilted to an upright position. Such an arrangement is known in the art and common in PVC windows. As discussed further, such spring-biased tilt locks can be made to cooperate with sash locks.

As shown at FIG. 1, the tilt lock release button 5 is in the locked or engaged position and is shown extending from tilt lock release button slot 8 of lock housing 2. The tilt lock 6 which is linked to the tilt lock release button 5 is also shown in the fully extended engaged position. In operation, tilt lock 6 will latch into vertical grooves in a window jamb 9 (shown in FIG. 8) to prevent lower sash 10 from tilting unless tilt locks are unlatched. Unlocking the sash to open the window via lock lever 15 can be done without any possibility of releasing the tilt lock.

Figure 3:
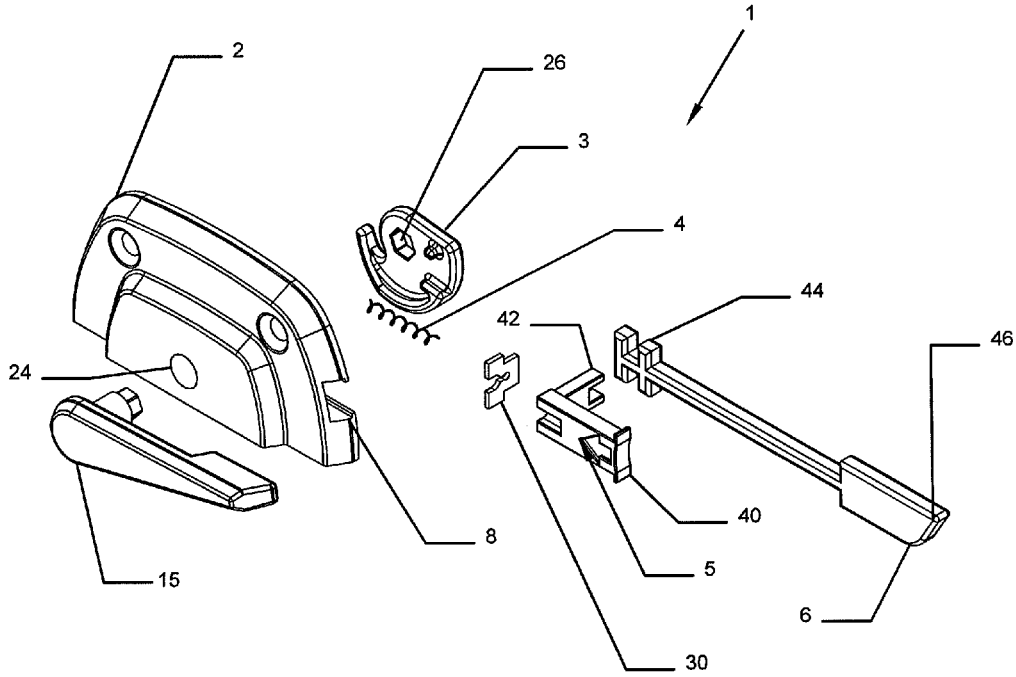
FIG. 3 is an exploded perspective of the combination tilt/sash lock of FIGS. 1 and 2.
Figure 4:
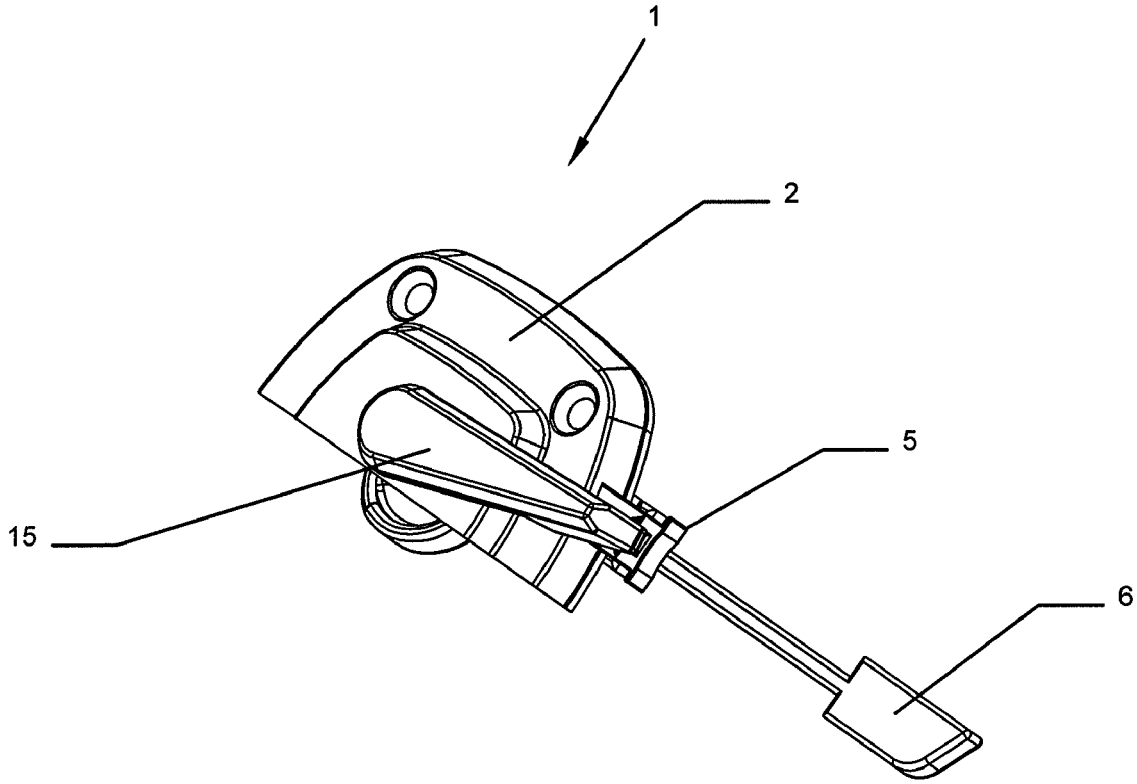
FIG. 4 is a top perspective view of a combination tilt/sash lock of FIGS. 1 and 2.
Figure 5:
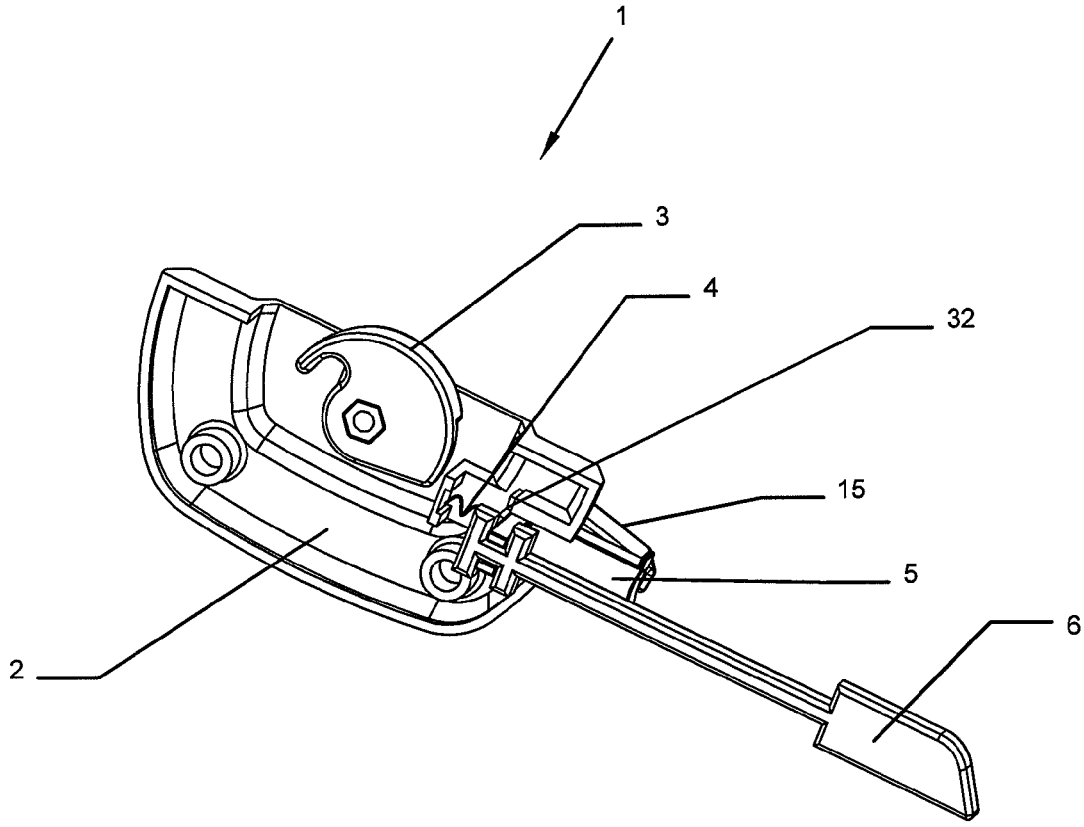
FIG. 5 is a bottom perspective view of the combination tilt/sash lock of FIGS. 1 and 2.

Many features of the combination tilt/sash lock 1 are configured such that they can be used on either side of a window sash 10. For example, the lock housing 2 is designed symmetrically such that the housing can be used for either a left or right lock. Additionally, the tilt lock button slot 8 can be located on both sides of the housing to allow installation of the tilt lock button on the left side or right side depending upon which side of the sash the lock is required. Also, the lock lever 15 can be used on both a left and right sash/latch lock by rotating it 180 degrees on the shaft axis. Further, tilt lock 6 can be used on either a left or right lock/latch by rotating 180 degrees on an axis perpendicular to the axis of movement. However, the locking cam 3 will require a left and right handed version for each application. The locking cam 3 shown in FIG. 3 is a right hand version. The left hand version would be mirror image of this.

As seen in FIG. 2 the lock lever 15 is in the unlocked position giving clearance to depress the tilt lock button 5 disengaging the tilt lock 6 and allow the sash 10 to be tilted out for cleaning or removal. In the embodiment shown in FIGS. 1-5, if tilting of lower sash is desired, it is necessary not only to unlock sash lock to the unlocked position shown in FIG. 2, but also to manually move tilt lock release button to the unlatched position shown in FIG. 2. Lower sash 10 can then be raised within the window and tilted open for washing or repair.

FIG. 8 shows a perspective cross section view of the right jamb, top and bottom sashes at the check rail. This shows the relationship of the tilt lock locking mechanism to the check rail and jamb liner of the window. The check rail plough 34 located underneath the check rail cover 14, which extends the entire width of the check rail, provides the housing for the tilt lock mechanism 6 to slide in.

In another embodiment of this disclosure, as seen in FIGS. 6 and 7, the combination tilt/sash lock 1 has two tilt locks or a double tilt lock. As can be seen, tilt lock release button 51 and tilt lock 61 are mirror images of release button 5 and tilt lock 6. Thus, the previously described construction and operation of the tilt lock mechanism is equally applicable for this embodiment, as is the sash lock mechanism. As such, the entire preceding description for combination tilt/sash lock 1 is incorporated for this embodiment as well. For this embodiment, the combination tilt/sash lock 1 will generally be horizontally centered on the sash such that it is positioned an equal distance from the left and right vertical edges of the sash. In such a location, the tilt locks 6 and 61 will be generally the same length. Additionally, the sash lock lever 15 would not need to be in superimposed relationship to the release button 5 since this configuration would require a two handed approach to tilting the sash for cleaning, making it virtually impossible to tilt the sash by accident. However, in the embodiment shown, sash lock lever 15, when in the locked position, is in a superimposed linear relationship with release button 5.

Although the invention has been described in detail with reference to particular examples and embodiments, the examples and embodiments contained herein are merely illustrative and are not an exhaustive list. Variations and modifications of the present invention will readily occur to those skilled in the art. The present invention includes all such modifications and equivalents. The claims alone are intended to set forth the limits of the present invention.

I claim:

1. A combination tilt/sash lock for mounting to a sash rail of a slideable and tiltable sash window, the combination comprising:

(a) a first tilt lock mechanism having a tilt lock and a release button, the tilt lock being movable by the release button from a latched position to an unlatched position; the latched position including the first tilt lock mechanism preventing the sash from tilting; the unlatched position permitting the sash to tilt; and (b) a sash lock mechanism having a rotatable cam and a locking lever, the rotatable cam being movable by the locking lever between a locked position and an unlocked position; the locked position including the sash lock mechanism preventing the sash from sliding; the unlatched position permitting the sash to slide;

(c) the locking lever and the release button being arranged in a superimposed linear relationship when the locking lever is in the locked position such that the locking lever blocks the tilt lock release button from being moved to the unlatched position.

2. The combination tilt/sash lock of claim 1 further comprising a biasing spring, the biasing spring being in contact with the tilt lock release button and providing a biasing force for holding the tilt lock mechanism in the locked position.

3. The combination tilt/sash lock of claim 2 wherein the tilt lock has a cammed end, the cammed end being constructed and arranged to permit the tilt lock to automatically retract when the window is moved from a tilted position to an upright position.

4. The combination tilt/sash lock of claim 1 wherein the tilt lock release mechanism is constructed and configured to operate in a linear direction.

5. The combination tilt/sash lock of claim 1, further comprising:

(a) a second tilt lock mechanism having a tilt lock, the tilt lock being movable by a tilt lock release button between a latched position and an unlatched position.

6. The combination tilt/sash lock of claim 5 further comprising:

(a) a first biasing spring, the first biasing spring being in contact with the tilt lock release button of the first tilt lock mechanism and providing a biasing force for holding the tilt lock mechanism in the locked position; and (b) a second biasing spring, the second biasing spring being in contact with the tilt lock release button of the second tilt lock mechanism and providing a biasing force for holding the tilt lock mechanism in the locked position.

7. The combination tilt/sash lock of claim 6 wherein the tilt lock release mechanism is constructed and configured to operate in a linear direction.

8. The combination tilt/sash lock of claim 6 wherein the tilt locks of the first and second tilt lock mechanisms each have a cammed end for allowing the tilt locks to automatically retract when the window is moved from a tilted position to an upright position.

9. The combination tilt/sash lock of claim 6 wherein the tilt lock of the first tilt lock mechanism has a length that is equal to a length of the tilt lock of the second tilt lock mechanism.

10. A double-hung window assembly comprising:

(a) an upper sash having a first and second stiles, a bottom check rail located at the bottom of the upper sash and a first lock keeper located on the bottom check rail;

(b) a lower sash having first and second stiles and a top check rail located at the top of the lower sash; and (c) a first combination tilt/sash lock mounted to the lower sash check rail, the combination comprising:

(i) a first tilt lock mechanism having a tilt lock and a tilt lock release button, the tilt lock being movable by the release button from a latched position to an unlatched position; the latched position including the first tilt lock mechanism preventing the sash from tilting; the unlatched position permitting the sash to tilt; and (ii) a sash lock mechanism having a rotatable cam and a locking lever, the rotatable cam being movable by the locking lever between a locked position and an unlocked position, the locked position including the rotatable cam being engaged with the first lock keeper on the upper sash thereby preventing the sash from sliding; the unlatched position permitting the sash to slide;

(iii) the locking lever and the tilt lock release button being arranged in a superimposed linear relationship when the locking lever is in the locked position such that the locking lever blocks the tilt lock release button from being moved to the unlatched position.

11. The double-hung window assembly of claim 10 further comprising a biasing spring, the biasing spring being in contact with the tilt lock release button and providing a biasing force for holding the tilt lock mechanism in the locked position.

12. The double-hung window assembly of claim 11 wherein the tilt lock has a cammed end, the cammed end being constructed and arranged to permit the tilt lock to automatically retract when the window is moved from a tilted position to an upright position.

13. The double-hung window assembly of claim 10 wherein the tilt lock release mechanism is constructed and configured to operate in a linear direction.

14. The double-hung window assembly of claim 10, further comprising:

(a) a second tilt lock mechanism having a tilt lock and a tilt lock release button, the tilt lock being movable by the release button from a latched position to an unlatched position; the latched position including the first tilt lock mechanism preventing the sash from tilting; the unlatched position permitting the sash to tilt.

15. The double-hung window assembly of claim 14 further comprising:

(a) a first biasing spring, the first biasing spring being in contact with the tilt lock release button of the first tilt lock mechanism and providing a biasing force for holding the first tilt lock mechanism in the locked position; and (b) a second biasing spring, the second biasing spring being in contact with the tilt lock release button of the second tilt lock mechanism and providing a biasing force for holding the second tilt lock mechanism in the locked position.

16. The combination tilt/sash lock of claim 15 wherein the tilt locks of the first and second tilt lock mechanisms each have a cammed end, each cammed end being constructed and arranged to permit the tilt lock to automatically retract when the window is moved from a tilted position to an upright position.

17. The double-hung window assembly of claim 14 wherein the tilt lock release mechanisms are constructed and configured to operate in a linear direction.

18. The double-hung window assembly of claim 14 wherein the tilt lock of the first tilt lock mechanism has a length that is equal to a length of the tilt lock of the second tilt lock mechanism.

19. The double hung window assembly of claim 10, further comprising:

(a) a second lock keeper located on the upper sash bottom check rail; and (b) a second combination tilt/sash lock mounted to the lower sash check rail, the combination comprising:

(i) a second tilt lock mechanism having a tilt lock and a tilt lock release button, the tilt lock being movable by the release button from a latched position to an unlatched position; the latched position including the first tilt lock mechanism preventing the sash from tilting; the unlatched position permitting the sash to tilt; and (ii) a second sash lock mechanism having a rotatable cam and a locking lever, the rotatable cam being movable by the locking lever between a locked position and an unlocked position; the locked position including the rotatable cam being engaged with the first lock keeper on the upper sash thereby preventing the sash from sliding; the unlatched position permitting the sash to slide;

(iii) the locking lever and the tilt lock release button being arranged in a superimposed linear relationship when the locking lever is in the locked position such that the locking lever blocks the tilt lock release button from being moved to the unlatched position.

20. The double-hung window assembly of claim 19 further comprising:

(a) a first biasing spring, the first biasing spring being in contact with the tilt lock release button of the first tilt lock mechanism and providing a biasing force for holding the first tilt lock mechanism in the locked position; and (b) a second biasing spring, the second biasing spring being in contact with the tilt lock release button of the second tilt lock mechanism and providing a biasing force for holding the second tilt lock mechanism in the locked position.

21. The double-hung window assembly of claim 20 wherein the tilt lock of the first and second tilt lock mechanisms each have a cammed end, each cammed end being constructed and arranged to permit the tilt lock to automatically retract when the window is moved from a tilted position to an upright position.

22. The double-hung window assembly of claim 19 wherein the tilt lock release mechanisms are constructed and configured to operate in a linear direction.

23. A combination tilt/sash lock for mounting to a sash rail of a slideable and tiltable sash window, the combination comprising:

(a) first tilt lock mechanism having a tilt lock and a tilt lock release button, the tilt lock being movable by the release button from a latched position to an unlatched position; the latched position including the first tilt lock mechanism preventing the sash from tilting; the unlatched position permitting the sash to tilt;

(a) a second tilt lock mechanism having a tilt lock and a tilt lock release button, the tilt lock being movable by the release button from a latched position to an unlatched position; the latched position including the second tilt lock mechanism preventing the sash from tilting; the unlatched position permitting the sash to tilt;

(c) a sash lock mechanism having a rotatable cam and a locking lever, the rotatable cam being movable by the locking lever between a locked position and an unlocked position; the locked position including the sash lock mechanism preventing the sash from sliding; the unlatched position permitting the sash to slide; and (d) a lock housing, the lock housing being connected to and receiving the first tilt lock mechanism, the second tilt lock mechanism, and the sash lock mechanism;

(e) wherein the combination tilt/sash lock is constructed and configured to prevent the window from tilting out of a window frame unless both release buttons are simultaneously depressed in a linear direction to the unlatched position;

(f) wherein the locking lever and the tilt lock release button of the first or second tilt lock mechanism are arranged in a superimposed linear relationship when the locking lever is in the locked position such that the locking lever blocks the tilt lock release button from being moved to the unlatched position.

* * * * *